US006264099B1

(12) United States Patent
Sakuma et al.

(10) Patent No.: US 6,264,099 B1
(45) Date of Patent: Jul. 24, 2001

(54) PACKAGING CARTON

(75) Inventors: Kouichi Sakuma, Yamagata; Akira Moriya, Tendou, both of (JP)

(73) Assignee: Suzuki Manufacturing, Ltd. (JP)

( * ) Notice: Subject to any disclaimer, the term of this patent is extended or adjusted under 35 U.S.C. 154(b) by 5 days.

(21) Appl. No.: 09/613,505

(22) Filed: Jul. 10, 2000

(51) Int. Cl.[7] ..... B65D 5/42

(52) U.S. Cl. ..... 229/169; 229/125.35; 229/164; 229/186

(58) Field of Search ..... 229/109, 125.35, 229/164, 169, 171, 186

(56) References Cited

U.S. PATENT DOCUMENTS

| | | | | |
|---|---|---|---|---|
| 3,565,324 | * | 2/1971 | Odenhagen | 229/171 |
| 3,701,467 | * | 10/1972 | Johansson | 229/186 |
| 4,533,065 | * | 8/1985 | Chazal et al. | 229/109 |
| 4,721,040 | * | 1/1988 | Mau | 229/186 |
| 5,244,145 | * | 9/1993 | Forbes, Jr. | 229/125.35 |
| 5,433,374 | * | 7/1995 | Forbes, Jr. | 229/125.35 |

* cited by examiner

*Primary Examiner*—Gary E. Elkins

(74) *Attorney, Agent, or Firm*—Lorusso & Loud

(57) ABSTRACT

A packaging carton is made by folding a quadrilateral sheet S1 in a polyhedron having specified length, width and height with a flat flange F1 provided around its periphery so that a sealing cover can be bonded on the flange. The quadrilateral sheet comprises four inward folding lines V1 to V4 each being formed to pass two of four corner points C1 to C4 of a bottom plane B1 of the polyhedron having the specified length and width, and four outward folding lines M1 to M4 each being formed to be in parallel with each of the four inward folding lines with a distance therefrom equal to the specified height, and to have a length equal to a distance between the two of the four corner points L1 or L2 on the inward folding line in parallel therewith. In a region formed at each corners of the quadrilateral sheet between two of four side planes SD1 to SD4 formed between the four inward folding lines and the four outward folding lines, respectively, the region comprises three outward folding lines M5 to M7 forming a triangle T1 extending from a vertex P1 at one of the corner points, two outward folding lines M8 and M9 each being formed to extend from each of the other two vertices P2 and P3 of the triangle in parallel with one of the four outward folding lines forming the side plane beyond the rest of the other two vertices, and two inward folding lines each being formed to extend from an end G1 to G8 of one of the four outward folding lines forming one of the side planes to one of the other two vertices near the end.

7 Claims, 14 Drawing Sheets

PACKAGING CARTON

BACKGROUND OF THE INVENTION

1. Field of the Invention

The present invention relates to a packaging carton, in particular to a packaging carton having a which has flange, on the upper face of which a sealing cover such as a transparent film can be bonded by fusion or adhesion with adhesives, so that it can be manufactured inexpensively and efficiently.

2. Description of the Related Art

Packaging cartons are traditionally manufactured by forming a sheet of film material, synthetic paper, or resin material with a forming tool. This manufacturing method requires an expensive forming tool which, when various kinds of packing cartons are manufactured, must be individually provided for each kind of the packing carton requiring much time and a large financial burden. In order to avoid this disadvantage, there is a method by which a packaging carton is provided by cutting a quadrilateral sheet from a strip sheet of film or paper conveyed in the longitudinal direction; providing the quadrilateral sheet with a first, second and third outward folding lines, a first, second and third inward folding lines, and angled inward folding lines; and folding the quadrilateral sheet to form a tray having a stepped flange around the periphery of the tray (JP-A-6-72425).

Moreover, there is a packaging technique in which a tray carton having a flange around the periphery thereof, is folded up from a carton blank cut in a specified shape (JP-A-60-240444 and U.S. Pat. No. 4,636,187, both being foreign applications of U.K. Patent 2158392).

However, the packaging cartons disclosed in the above patent documents have following drawbacks. In the former, the carton is formed with a flange being stepped without being formed to be flat making it difficult to bond a sealing cover, such as a transparent film, by fusion or adhesion with adhesives. In the latter, the periphery of the carton blank must be cut in a specified shape for the folded up tray to provide a flange around the periphery thereof, which may cause chips of the carton blank to enter inside the tray carton. This makes the tray carton unsuitable as a packaging carton for packing foods.

The present invention was made in order to eliminate the above drawbacks with an object of providing a packaging carton which has a flat formed flange on the upper face of which a sealing cover such as a transparent film can be bonded, and can be inexpensively manufactured with high efficiency.

SUMMARY OF THE INVENTION

In order to achieve such object, a packaging carton according to the first aspect of the present invention is made by folding a quadrilateral sheet in a polyhedron with the specified length, width and height with a flat flange provided around a periphery thereof.

The quadrilateral sheet comprises: four inward folding lines each being formed to pass two of four corner points of a bottom plane of the polyhedron having the specified length and width; and four outward folding lines each being formed to be in parallel with each of the four inward folding lines with a distance therefrom equal to the specified height, and to have a length equal to a distance between the two of the four corner points on the inward folding line in parallel therewith.

In a region formed at each of four corners of the quadrilateral sheet between two of the four side planes formed between the four inward folding lines and the four outward folding lines, respectively, the region comprises: three outward folding lines forming a triangle extending from a vertex at one of the corner points; two outward folding lines each being formed to extend from each of the other two vertices of the triangle in parallel with one of the four outward folding lines forming the side plane beyond the rest of the other two vertices; and two inward folding lines each being formed to extend from an end of one of the four outward folding lines forming one of the side planes to one of the other two vertices near the end.

A packaging carton according to the second aspect of the present invention is made by folding a quadrilateral sheet in a polyhedron with the specified length, width and height with a flat flange provided around a periphery thereof.

The quadrilateral sheet comprises: four inward folding lines each being formed to connect two of four corner points of a bottom plane of the polyhedron having the specified length and width; and four outward folding lines each being formed to be in parallel with each of the four inward folding lines with a distance therefrom equal to the specified height.

In a region formed at each of four corners of the quadrilateral sheet including each of the four corner points, the region comprises: two inward folding lines which extend from one of the corner points to the ends of the two of the four outward folding lines near the corner point, respectively; one inward folding line which connects the ends of two of the four outward folding lines near the corner point; one outward folding line dropped from the corner point as a vertex of a triangle, formed with the two inward folding lines and the one inward folding line, to the one inward folding line as a base so as to divide the triangle into two; two inward folding lines each extending from each of the other two vertices of the triangle in parallel with one of the four outward folding lines extended to the end as the rest of the other two vertices; and two outward folding lines each extending from an end of the one outward folding line on the one inward folding line as the base in parallel with one of the four outward folding lines extended to the one of the other two vertices beyond the other of the two outward folding lines.

According to the forms of the packaging cartons in the first and second aspects, a quadrilateral sheet is cut out from a strip sheet of film or paper conveyed in the longitudinal direction. From the quadrilateral sheet, a packaging carton, having a flattened flange on the upper face of which a sealing cover such as a transparent film can be bonded, can be inexpensively manufactured with high efficiency.

Moreover, a packaging carton according to the third aspect of the present invention is made by folding a quadrilateral sheet in a polyhedron formed to have a bottom plane with specified length and width, a pair of facing long side planes each with a specified long height, a pair of facing short side planes each with a specified short height, two pairs of facing inclined side planes each being in the form of a triangle formed between the long side plane and the short side plane with one side connected to the long side plane, one of the other two sides connected to the short side plane and one vertex between the above sides being at each of four corner points of the bottom plane, and a flange formed with a continuous face and provided around a periphery.

The quadrilateral sheet comprises: two first inward folding lines, each formed to pass two of four corner points of a bottom plane of the polyhedron having the specified length and width, and to have a length equal to a sum of the specified width, twice the specified short height, and twice the width of the flange; two second inward folding lines, each formed to cross the two first inward folding lines at right angles to connect two of the four corner points, and to have a length equal to the specified length; two outward folding lines each being formed to have a length equal to the specified length between two of the four corner points and to be in parallel with one of the second inward folding lines with a distance therefrom equal to the specified short height; two pairs of inward folding lines each line extending from each end of the second inward folding line at one of the four corner points, and forming the one side of the triangle connected to the one of the long side planes; two pairs of outward folding lines each pair extending from both ends of each pair of the inward folding lines in parallel with the second inward line; and two outward folding lines each being formed to have a length equal to a distance between the two pairs of the outward folding lines and to be in parallel with one of the first inward folding lines with a distance therefrom equal to the specified long height.

In a region formed at each of four corners of the quadrilateral sheet between the long side plane and short side plane, the region comprises: an inward folding line which extends from one of the two outward folding lines having the length equal to the specified length, and being in parallel with the second inward folding line; two outward folding lines, forming the other two sides of the triangle, drawn from a point as one of the other vertices at an end of the inward folding line; and an outward folding line formed to extend from the point as the one of the other vertices of the triangle in parallel with the first inward folding line.

In the package carton according to the third aspect of the present invention, each pair of the two pairs of outward folding lines which extend from both ends of each pair of the two pairs of the inward folding lines are formed at a distance equal to the specified width from the other pair of outward folding lines.

Also in the package carton according to the third aspect of the present invention, each pair of the two pairs of outward folding lines which extend from both ends of each pair of the two pairs of the inward folding lines are formed at a distance smaller than the specified width from the other pair of outward folding lines.

Furthermore, in the package carton according to the third aspect of the present invention, each pair of the two pairs of outward folding lines which extend from both ends of each pair of the two pairs of the inward folding lines are formed at a distance larger than the specified width from the other pair of outward folding lines.

In addition, a packaging carton according to the fourth aspect of the present invention is made by folding a quadrilateral sheet in a polyhedron having a bottom plane with specified length and width, a pair of facing triangular long side planes each with a specified long height, a pair of facing quadrilateral short side planes each with a specified short height, two pairs of facing inclined side planes each being in a form of a triangle formed between the long side plane and the short side plane with one side connected to the long side plane, one of the other two sides connected to the short side plane and one of vertices between the above sides being at one of four corner points of the bottom plane, and a flange formed with a continuous face and provided around a periphery.

The quadrilateral sheet comprises: two first inward folding lines each being formed to pass two of the four corner points of a bottom plane of the polyhedron having the specified length and width, and to have a length equal to a sum of the specified width, twice the specified short height, and twice the width of the flange; two second inward folding lines each crossing the two first inward folding lines at right angles, and with a length equal to the specified length; two outward folding lines each being formed to have a length equal to the length of the second inward folding line and to be in parallel therewith with a distance therefrom equal to the specified short height; and two outward folding line each extending in parallel with the second inward folding line from a vertex of each of the pair of the triangles of the long side planes.

In a region formed at each of four corners of the quadrilateral sheet between the long side plane and short side plane, the region comprises: an inward folding line forming the one side of the triangle connected to the one of the long side planes; two outward folding lines, forming the other two sides of the triangle, drawn from a point as one of the other vertices at a distance from an imaginary extension of the second inward folding line being equal to the short height of the short side plane; an inward folding line formed to extend in parallel with the second inward line to the point as one of the other vertices from an end of one of the two outward folding lines; and an outward folding line formed to extend from the point as the one of the other vertices of the triangle in parallel with the first inward folding line.

According to the forms of the packaging cartons in the third and fourth aspects, a quadrilateral sheet is cut out from a strip sheet of film or paper conveyed in the longitudinal direction. From the quadrilateral sheet, a packaging carton, having a flange with flattened bent portions, on the upper face of which a sealing cover such as a transparent film can be bonded, can be inexpensively manufactured with high efficiency. Moreover, in the packaging carton in the third aspect in which the flange, positioned at the top of the carton, can be made in parallel with the bottom face, it is possible to vary the length of the flange formed in parallel with the bottom face.

DETAILED DESCRIPTION OF THE INVENTION

Preferred embodiments of the packaging cartons according to the present invention will be explained in detail in the following with reference to the drawings.

First Embodiment

Figure 3:
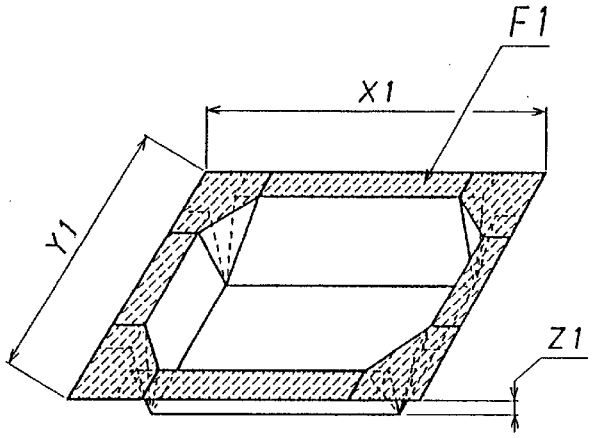
FIG. 3 is a perspective view showing the packaging carton in the first embodiment according to the present invention.

In the embodiment, a packaging carton according to the present invention is that made by folding a quadrilateral sheet S1 (FIG. 1) in a polyhedron having specified length X1, width Y1 and height Z1 with a flat flange F1 (FIG. 3) provided around a periphery thereof.

In order to make the package carton, the quadrilateral sheet SI comprises four inward folding lines V1 to V4, each being formed to pass two of four corner points C1 to C4 (FIG. 1) of a bottom plane B1 of the polyhedron having the specified length X1 and width Y1, and four outward folding lines M1 to M4 each being formed to be in parallel with each of the four inward folding lines V1 to V4 with a distance therefrom equal to the specified height Z1, and to have a length equal to a distance between the two of the four corner points L1 or L2 on the inward folding line in parallel therewith.

Figure 1:
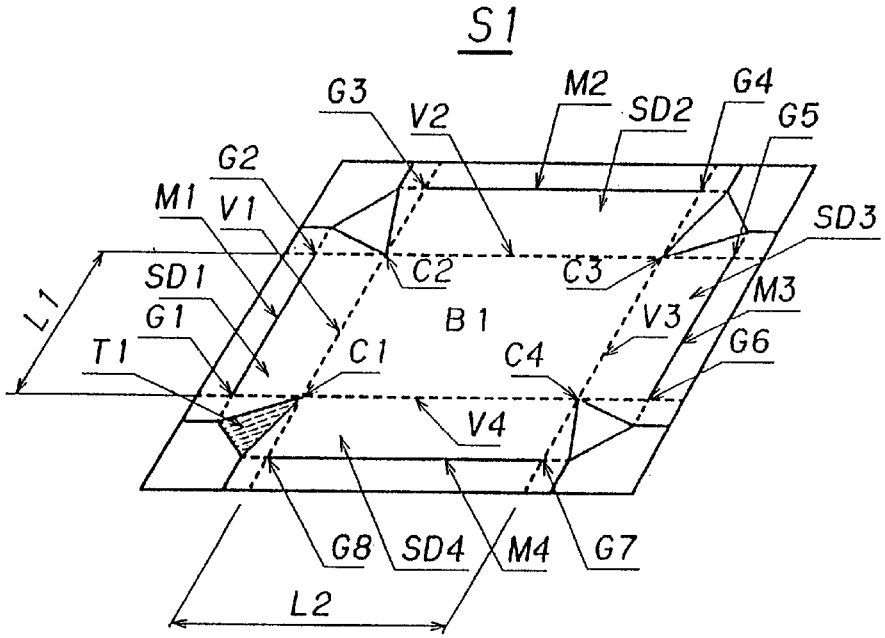
FIG. 1 is a perspective view showing a quadrilateral sheet provided with inward folding lines and outward folding lines for forming a packaging carton in a first embodiment according to the present invention.
Figure 2:
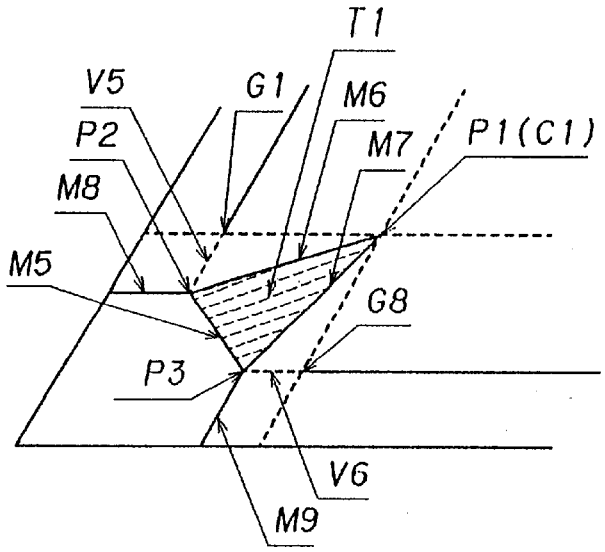
FIG. 2 is a partial perspective view showing a region at a corner of the quadrilateral sheet provided with inward folding lines and outward folding lines for forming the packaging carton in the first embodiment according to the present invention.

In a region formed at each of four corners of the quadrilateral sheet between two of four side planes SD1 to SD4 formed between the four inward folding lines V1 to V4 and the four outward folding lines M1 to M4, respectively, the region comprises three outward folding lines M5 to M7 forming a triangle T1 extending from a vertex P1 (FIG. 2) at one of the corner points C1 to C4; two outward folding lines M8 and M9 each being formed to extend from each of the other two vertices P2 and P3 of the triangle T1 in parallel with one of the four outward folding lines M1 to M4 forming the side plane beyond the rest of the other two vertices; and two inward folding lines V5 and V6 each being formed to extend from an end G1 to G8 of one of the four outward folding lines forming one of the side planes to one of the other two vertices near the end. In FIG. 1 and FIG. 2, the inward folding lines and the outward folding lines are represented by broken lines and solid lines, respectively.

The quadrilateral sheet S1 (FIG. 4A) comprising the above inward folding lines and outward folding lines shown in FIG. 1 and FIG. 2 is folded as described below.

Figure 4:
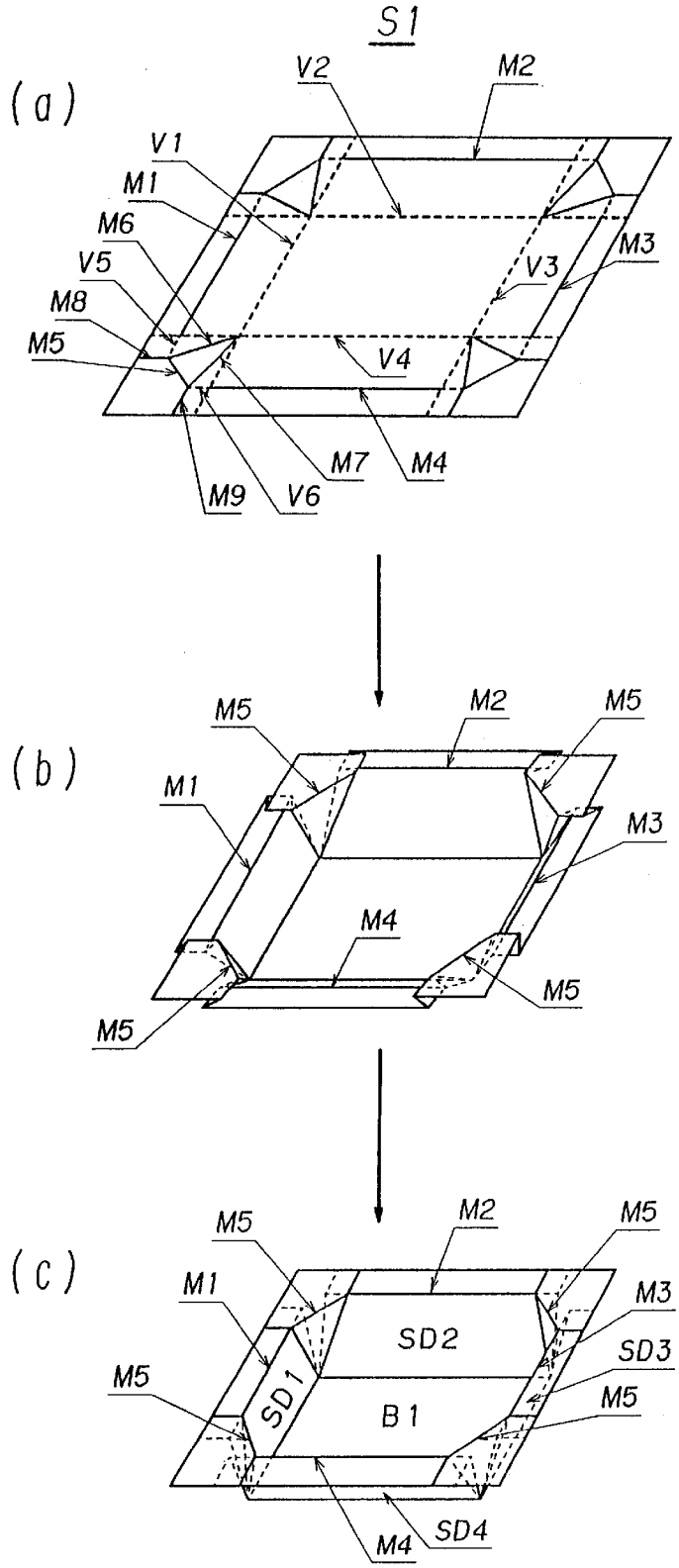
FIGS. 4A to 4C are perspective views showing the steps of forming the packaging carton in the first embodiment according to the present invention.

The four inward folding lines V1 to V4 are folded inward and the four outward folding lines M1 to M4 are folded outward, and in each of regions at the four corners of the quadrilateral sheet S1, the two inward folding lines V5 and V6 are folded inward and the three outward folding lines M5 to M7 forming the triangle T1, the two outward folding lines M8 and M9 are folded outward, by which a package carton is obtained in a form before being completed (FIG. 4B). The above inward and outward folding is further carried out completely for the completion of the package carton (FIG. 3 and FIG. 4C), which is formed with the four side planes SD1 to SD4 each connected by the triangle T1 on the bottom plane B1 of the polyhedron, four outward folding lines M1 to M4 each connected by the outward folding line M5 and a flat flange F1 extending from the outward folding lines M1 to M4 and M5 in the horizontal direction on all sides of the periphery.

Figure 5:
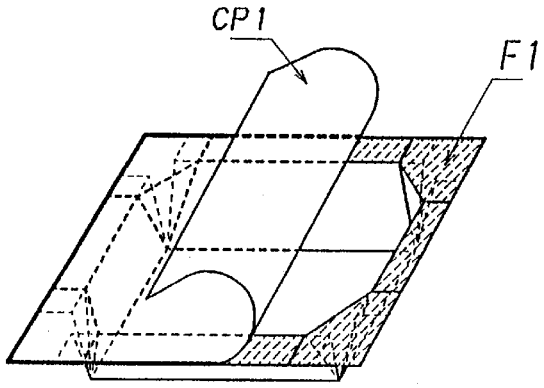
FIG. 5 is a perspective view showing the step of sealing the packaging carton in the first embodiment according to the present invention.

Into the packaging carton thus formed, contents (not shown in the drawings) are put to be held with a sealing cover CP 1 (FIG. 5) applied over the contents and mounted on the flange F1 to be bonded thereto by, for example, fusing. This constitutes a sealed packaging carton in which contents such as food or drink are held.

Second Embodiment

Figure 8:
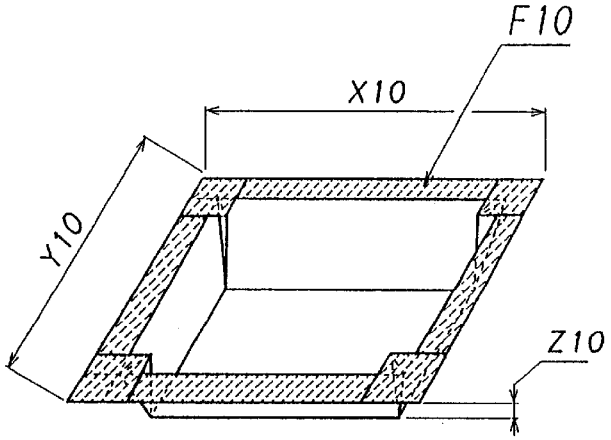
FIG. 8 is a perspective view showing the packaging carton in the second embodiment according to the present invention.

In the embodiment, a packaging carton according to the present invention is that made by folding a quadrilateral sheet S10 (FIG. 6) in a polyhedron having specified length X10, width Y10 and height Z10 with a flat flange F10 (FIG. 8) provided around a periphery thereof.

In order to make the package carton, the quadrilateral sheet S10 comprises: four inward folding lines V10 to V40 each being formed to connect two of four corner points C10 to C40 (FIG. 6) of a bottom plane B10 of the polyhedron having the specified length X10 and width Y10; and four outward folding lines M10 to M40 each being formed to be in parallel with each of the four inward folding lines V10 to V40 with a distance therefrom equal to the specified height Z10.

Figure 6:
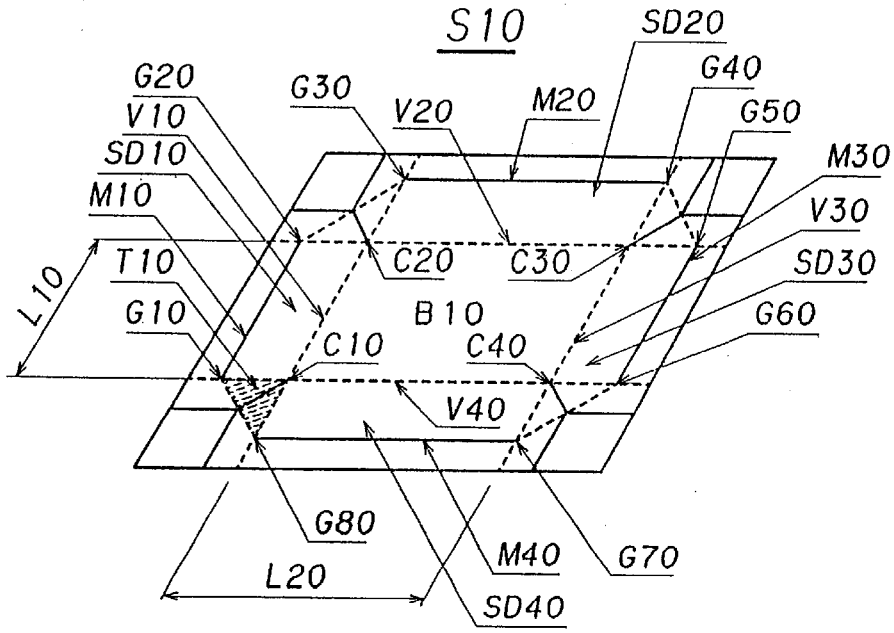
FIG. 6 is a perspective view showing a quadrilateral sheet provided with inward folding lines and outward folding lines for forming a packaging carton in a second embodiment according to the present invention.
Figure 7:
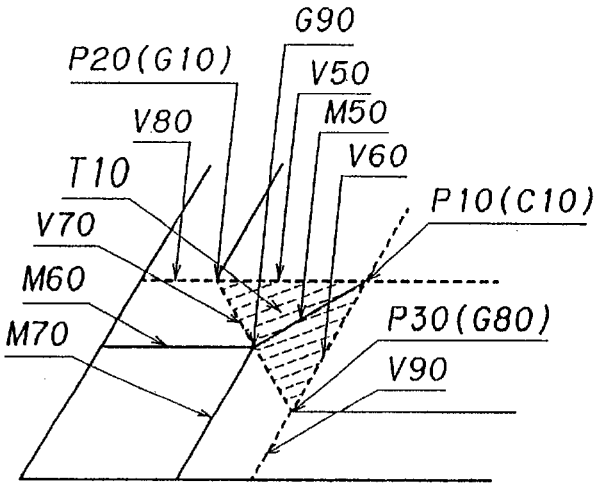
FIG. 7 is a partial perspective view showing a region at a corner of the quadrilateral sheet provided with inward folding lines and outward folding lines for forming the packaging carton in the second embodiment according to the present invention.

In a region formed at each of four corners of the quadrilateral sheet S10 including each of the four corner points C10 to C40, the region comprises: two inward folding lines V50 and V60 (FIG. 7) being formed to extend from one of the corner points C10 to C40 to two of the ends G10 to G80 of the two of the four outward folding lines M10 to M40 near the corner point, respectively; one inward folding line V70 being formed to connect the two of the ends G10 to G80 of the two of the four outward folding lines M10 to M40 near the corner point; one outward folding line M50 dropped from the corner point C10, one of the four corner points C10 to C40, as a vertex P10 of a triangle T10, formed with the two inward folding lines V50 and V60 and the one inward folding line V70, to the one inward folding line V70 as a base so as to divide the triangle into two; two inward folding lines V80 and V90 each being formed to extend from each of the other two vertices P20 and P30 of the triangle T10 in parallel with one of the four outward folding lines M10 to M40 extended to the end as the rest of the other two vertices P20 and P30; and two outward folding lines M60 and M70 each being formed to extend from an end G90 of the one outward folding line M50 on the one inward folding line as the base so as to be in parallel with one of the four outward folding lines M10 to M40 extended to the one of the other two vertices P20 and P30 beyond the other of the two outward folding lines M60 and M70. In FIG. 6 and FIG. 7, the inward folding lines and the outward folding lines are represented by broken lines and solid lines, respectively.

The quadrilateral sheet S10 (FIG. 9A), comprising the above inward folding lines and outward folding lines shown in FIG. 6 and FIG. 7, is folded as described below.

Figure 9:
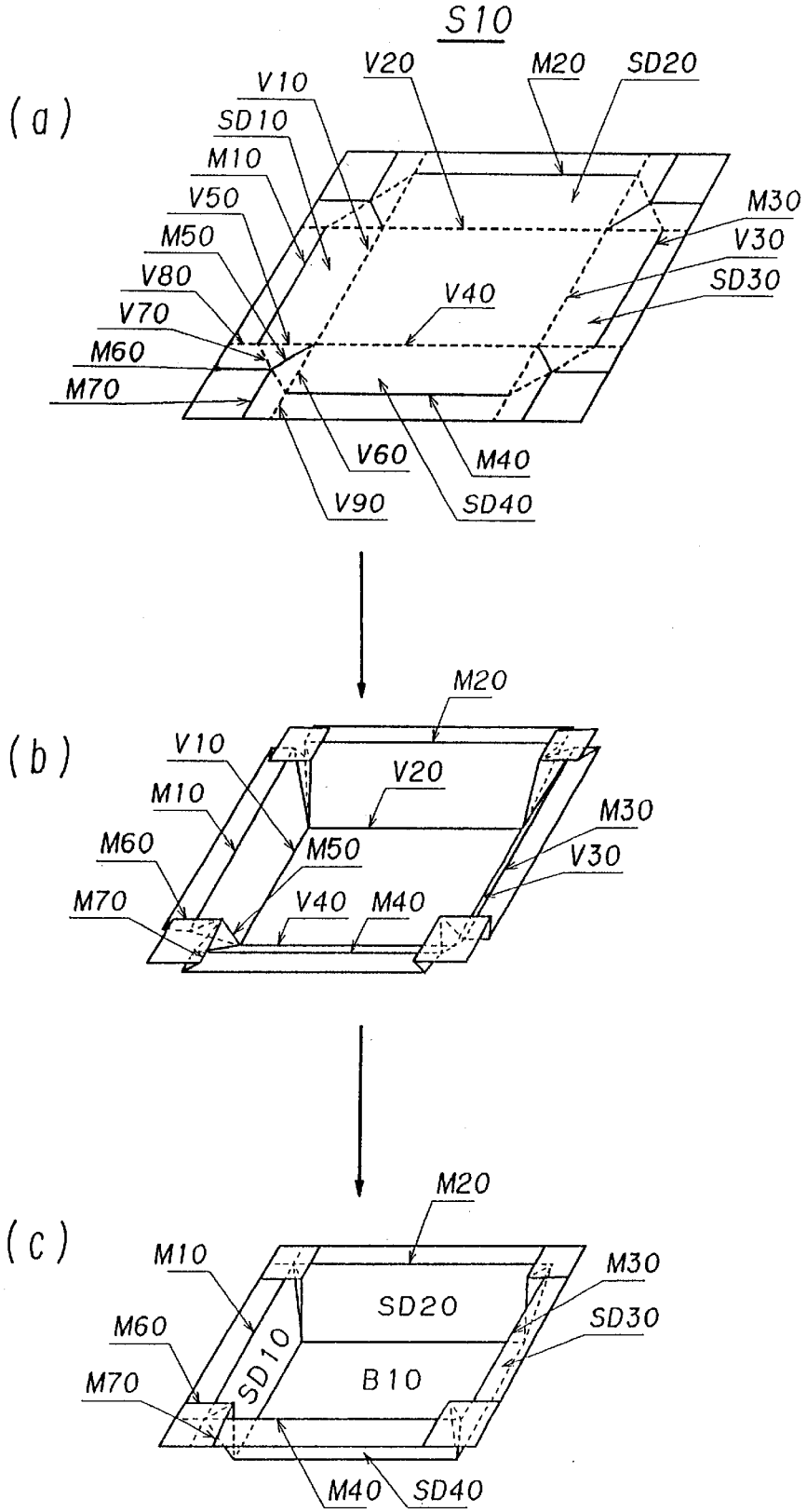
FIGS. 9A to 9C are perspective views showing the steps of forming the packaging carton in the second embodiment according to the present invention.

The four inward folding lines V10 to V40 are folded inward and the four outward folding lines M10 to M40 are folded outward, and in each of regions at the four corners of the quadrilateral sheet S10, the two inward folding lines V50 and V60, the one inward folding line V70 and the two inward folding lines V80 and V90 are folded inward, and the one outward folding line M50, and the two outward folding lines M60 and M70 are folded outward, by which a package carton is obtained in a form before being completed (FIG. 9B). The above inward and outward folding is further carried out completely to completion of the package carton (FIG. 8 and FIG. 9C), which is formed with the four side planes SD10 to SD40 each connected by the triangle T10 folded in two on the bottom plane B10 of the polyhedron, four outward folding lines M10 to M40 each connected through the triangle T10 folded in two and a flat flange F10 extending from the outward folding lines M10 to M40 in the horizontal direction on all sides of the periphery.

Figure 10:
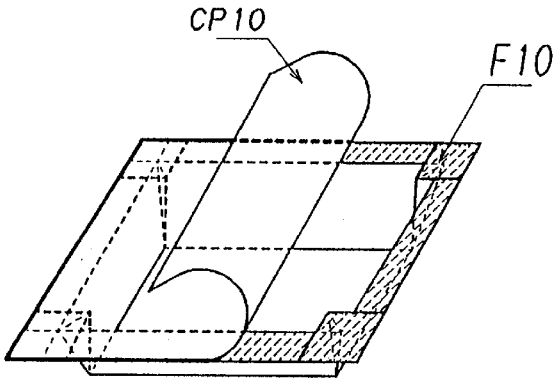
FIG. 10 is a perspective view showing the step of sealing the packaging carton in the second embodiment according to the present invention.

Into the packaging carton thus formed, contents (not shown in the drawings) are put to be held with a sealing cover CP 1 (FIG. 10) applied over the contents and mounted on the flange F10 to be bonded thereto by, for example, fusing to constitute a sealed packaging carton in which contents such as food or drink are held.

Third Embodiment

Figure 12:
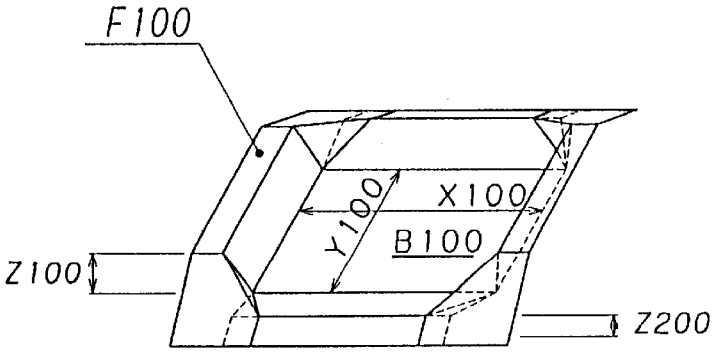
FIG. 12 is a perspective view showing the packaging carton in the third embodiment according to the present invention.
Figure 11:
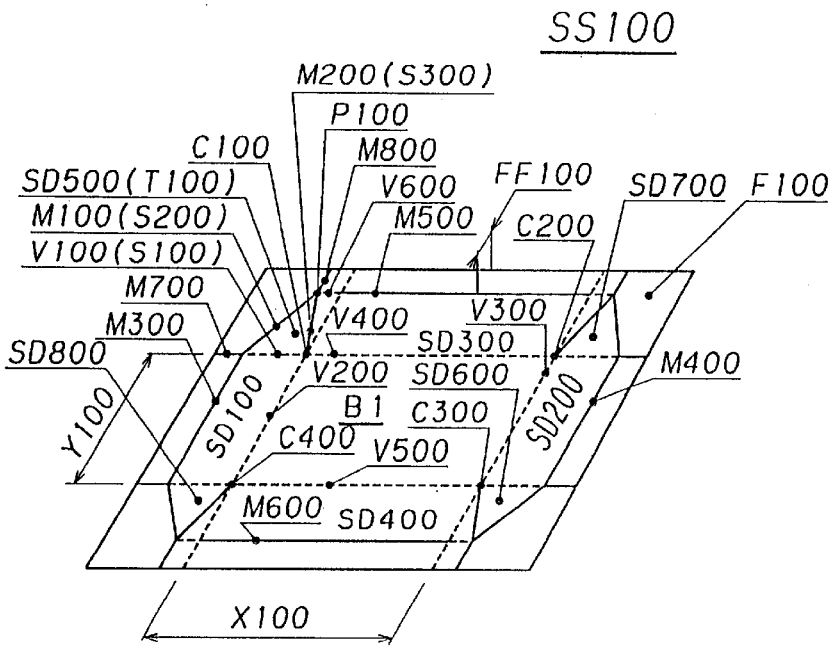
FIG. 11 is a perspective view showing a quadrilateral sheet provided with inward folding lines and outward folding lines for forming a packaging carton in a third embodiment according to the present invention.
Figure 13:
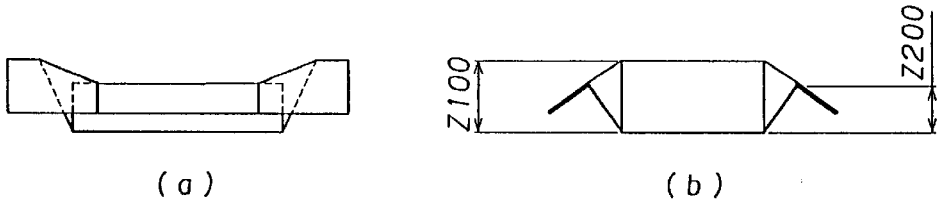
FIG. 13A is a front view showing the package carton in the third embodiment according to the present invention.
FIG. 13B is a side view showing the package carton in the third embodiment according to the present invention.

In the embodiment, a packaging carton according to the present invention is made in a polyhedron by folding a quadrilateral sheet SS100 as shown in FIG. 11, FIG. 12 and FIG. 13. The package carton made in a polyhedron is formed to have a bottom plane B100 with specified length X100 and width Y100, a pair of facing long side planes SD100 and SD200 each with a specified long height Z100, a pair of facing short side planes SD300 and SD400 each with a specified short height Z200, two pairs of facing inclined side planes SD500 to SD800 each being in a form of a triangle T100 formed between the long side plane SD 100 or SD 200 and the short side plane SD300 or SD400 with one side S100 connected to the long side plane SD100 or SD200, one side S300 of the other two sides S200 and S300 connected to the short side plane SD 300 or SD400 and one vertex between the above sides S100 and S300 being at each of four corner points C100 to C400 of the bottom plane B100, and a flange F100 formed with a continuous face and provided around a periphery.

In order to make the package carton, the quadrilateral sheet SS100 comprises: two first inward folding lines V200 and V300 each being formed to pass two of four corner points C100 to C400 of a bottom plane B100 of the polyhedron having the specified length X100 and width Y100, and to have a length equal to a sum of the specified width Y100, twice the specified short height Z200, and twice a width FF100 of the flange F100; two second inward folding lines V400 and V500 each being formed to cross the two first inward folding lines V200 and V300 at right angles to connect two of the four corner points C100 to C400, and to have a length equal to the specified length X100; two outward folding lines M500 and M600 each being formed to have a length equal to the specified length X100 between two of the four corner points C100 to C400 and to be in parallel with one of the second inward folding lines V400 and V500 with a distance therefrom equal to the specified short height Z200; two pairs of inward folding lines V100 each line extending from each end of the second inward folding line V400 or V500 at one of the four corner points C100 to C400, and forming the one side S100 of the triangle T100 connected to the one of the long side planes SD100 and SD200; two pairs of outward folding lines M700 each pair being formed to extend from both ends of each pair of the folding lines V100 in parallel with the second inward folding line V400 or V500; and two outward folding lines M300 and M400 each being formed to have a length equal to a distance between the two pairs of the outward folding lines M700 and to be in parallel with one of the first inward folding lines V200 and V300 with a distance therefrom equal to the specified long height Z100.

Figure 14:
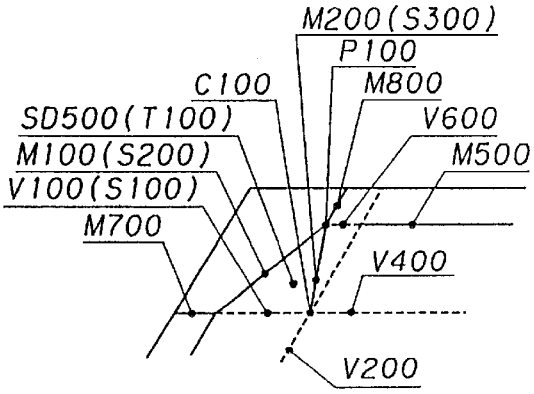
FIG. 14 is a partial perspective view showing a region at a corner of the quadrilateral sheet provided with inward folding lines and outward folding lines for forming the packaging carton in the third embodiment according to the present invention.

In a region formed at each of the four corners of the quadrilateral sheet SS100 between the long side plane SD100 or SD200 and the short side plane SD300 or SD400, as shown in FIG. 14, the region including the inclined side plane SD 500 as the triangle T100 comprises: an inward folding line V600 being formed to extend from the outward folding line M500 having the length equal to the specified length X100, and being in parallel with the second inward folding line V400; two outward folding lines M100 and M200, forming the other two sides S200 and S300 of the triangle T100 as the inclined side plane SD500, drawn from a point P100 as one of the other vertices at an end of the inward folding line V600; and an outward folding line M800 formed to extend from the point P100 as the one of the other vertices of the triangle in parallel with the first inward folding line V200. Therefore, such outward folding lines M100, M200, M700 and M800, and inward folding line V600 are also provided in the other three regions at the respective three other corners of the quadrilateral sheet SS100 including the inclined side planes SD600 to SD800 (FIG. 11).

In FIG. 11 and FIG. 14, the inward folding lines and the outward folding lines are represented by broken lines and solid lines, respectively.

The quadrilateral sheet SS100 (FIG. 15A) comprising the above inward folding lines and outward folding lines shown in FIG. 11 and FIG. 14 is folded as described below.

The two first inward folding lines V200 to V300, the two second inward folding lines V400 and V500 and the two pairs of the inward folding lines V100 are folded inward, and the two outward folding lines M300 and M400, the two outward folding lines M500 and M600 and the two pairs of the outward folding lines M700 are folded outward. Further, in each of the regions at the four corners of the quadrilateral sheet SS100, the two outward folding lines M100 and M200 and the outward folding line M800 are folded outward, and the inward folding line V600 is folded inward, by which a package carton is obtained in a form before being completed (FIG. 15B). Following this, the above inward and outward folding is further carried out completely to completion of the package carton (FIG. 15C), which is formed with the four side planes SD100 to SD400 each connected by the triangle T100 on the bottom plane B100 of the polyhedron, four outward folding lines M300 to M600 each connected by the outward folding line M100, and a flat flange F100 extending from the outward folding lines M300 to M600 and M100 in the horizontal direction on all sides of the periphery. The four side planes SD100 to SD400 are formed so that the long side planes SD100 and SD200 have the specified long height Z100 and the short side planes SD300 to SD400 have the specified short height Z200. This allows only portions F100 of the flange along the long side planes SD100 and SD200 to be formed in parallel with the bottom plane B100 with the other portions of the flange F100 bent downward from the ends of the portions along the long side planes SD100 and SD200.

Figure 16:
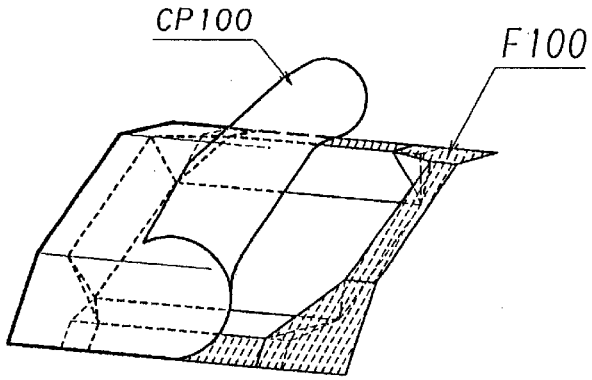
FIG. 16 is a perspective view showing the step of sealing the packaging carton in the third embodiment according to the present invention.

Into the packaging carton thus formed, contents (not shown in the drawings) are put to be held with a sealing cover CP 100 (FIG. 16) is applied over the contents and mounted on the flange F100 to be bonded thereto by, for example, fusing to constitute a sealed packaging carton in which contents such as food or drink are held.

Figure 15:
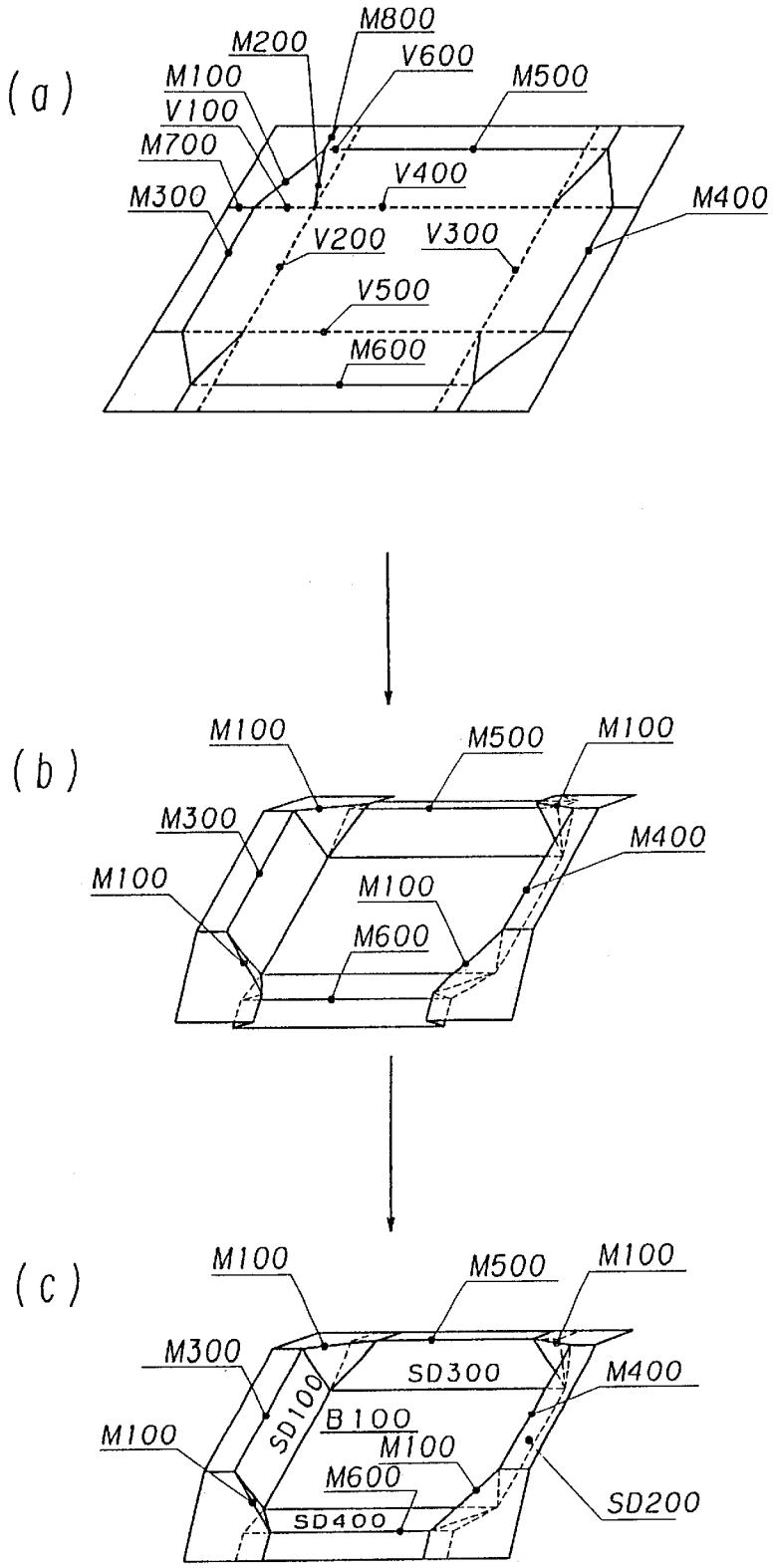
FIGS. 15A to 15C are perspective views showing the steps of forming the packaging carton in the third embodiment according to the present invention.
Figure 17:
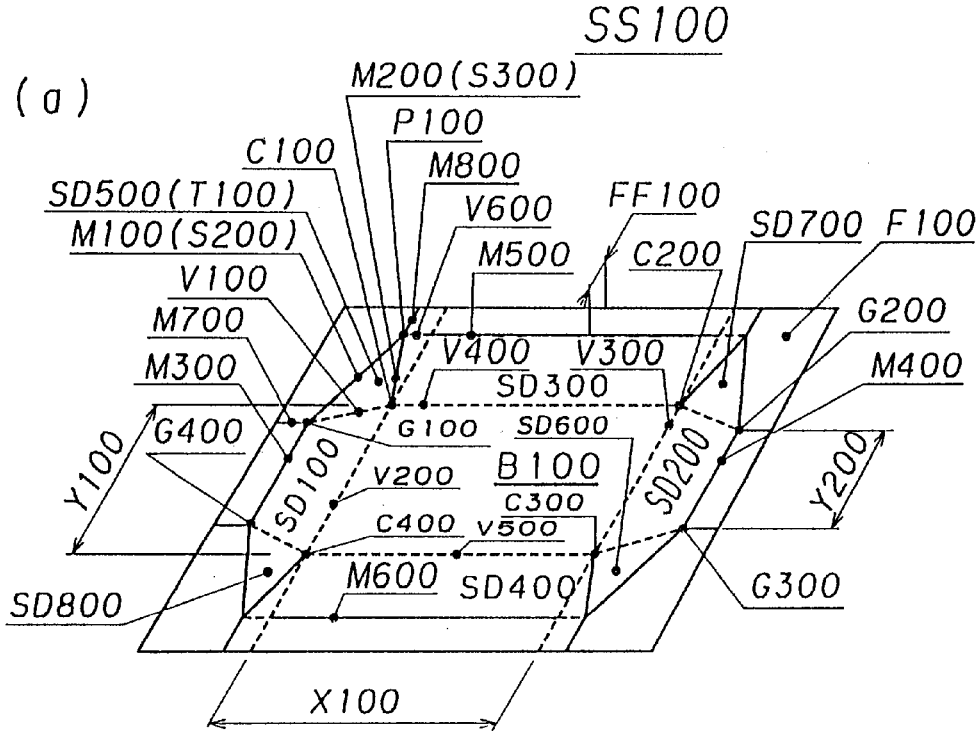
FIG. 17A is a perspective view showing a quadrilateral sheet provided with inward folding lines and outward folding lines for forming a packaging carton in a modification of the third embodiment according to the present invention.
FIG. 17B is a partial perspective view showing a region at a corner of the quadrilateral sheet shown in FIG. 17A.
Figure 17:
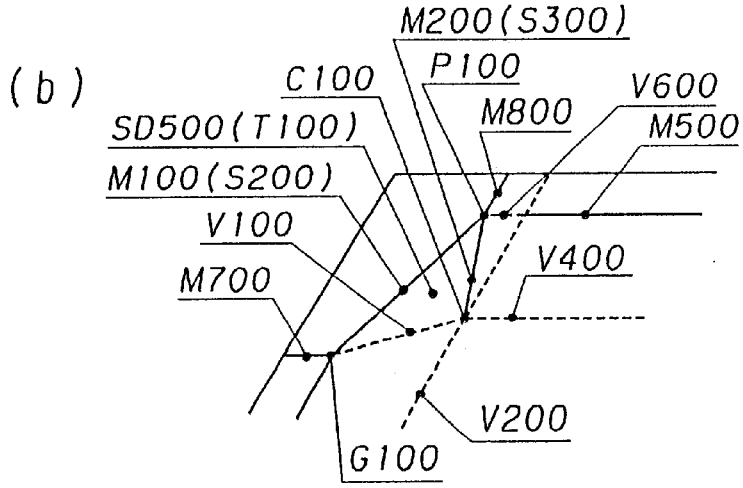

In the above explained quadrilateral sheet SS100 shown in FIG. 11 and FIG. 15A, each pair of the two pairs of outward folding lines M700 which extend from both ends of each pair of the two pairs of the inward folding lines V100 are provided at a distance equal to the specified width Y100 from the other pair of outward folding lines so that the outward folding line M700, the inward folding line V100 and the second inward folding line V400 or V500 are on a straight line. However, the present invention is not limited to this, and, as in the quadrilateral sheet SS100' shown in FIGS. 17A and 17B, each pair of the two pairs of outward folding lines M700' which extend from both ends G100 and G200, or G300 or G400 of each pair of the two pairs of the inward folding lines V100' may be formed at a distance Y200 smaller than the specified width Y100 from the other pair of outward folding lines. In FIGS. 17A and 17B, since the inward and outward folding lines other than the inward folding lines V100' and the outward folding lines M700' are identical with those in FIGS. 11 to 15C, they are denoted by the same numeral with the description thereof being omitted.

Figure 19:
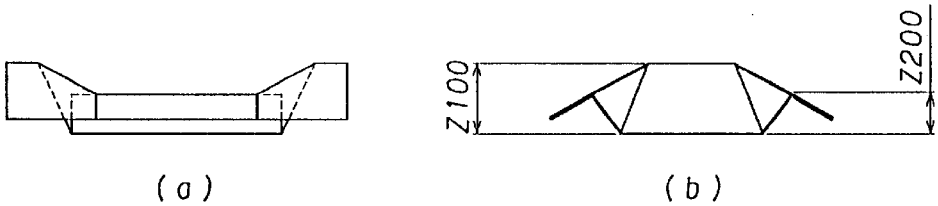
FIG. 19A is a front view showing the package carton shown in FIG. 18.
FIG. 19B is a side view showing the package carton shown in FIG. 18.
Figure 18:
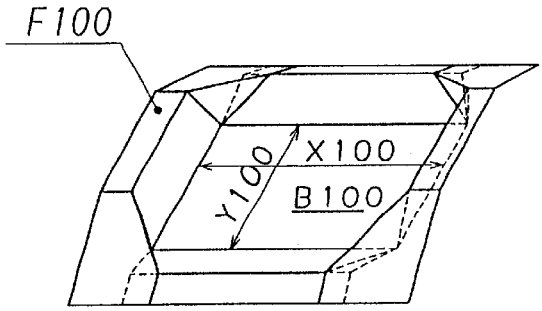
FIG. 18 is a perspective view showing the packaging carton completed by folding the quadrilateral sheet shown in FIGS. 17A and 17B.

The quadrilateral sheet SS100' is folded in the same way as explained above to be provided as a packaging carton as shown in FIG. 18 and FIG. 19. This provided packaging carton has a flange F100 as a plane formed in parallel with the bottom plane B100 with a length allowed to be shorter than that of the carton made by folding the quadrilateral sheet SS100.

Figure 20:
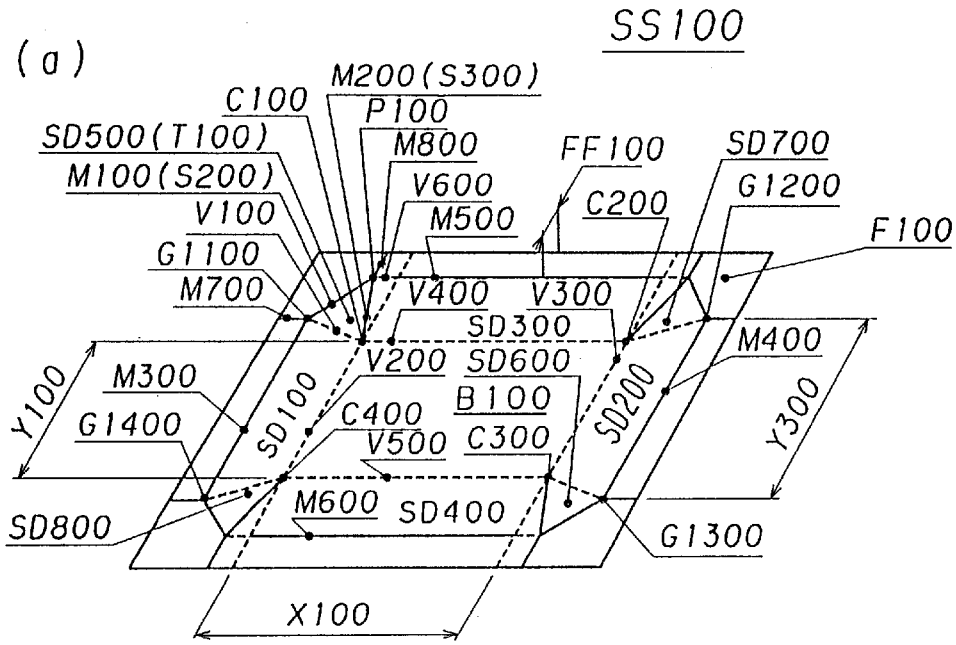
FIG. 20A is a perspective view showing a quadrilateral sheet provided with inward folding lines and outward folding lines for forming a packaging carton in another modification of the third embodiment according to the present invention.
FIG. 20B is a partial perspective view showing a region at a corner of the quadrilateral sheet shown in FIG. 20A.
Figure 20:
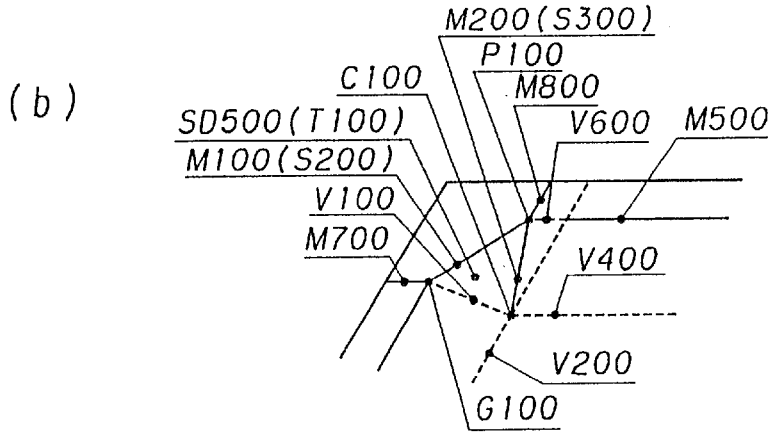

Moreover, as in a quadrilateral sheet SS100" shown in FIGS. 20A and 20B, each pair of the two pairs of outward folding lines M700" which extend from both ends G1100 and G1200, or G1300 or G1400 of each pair of the two pairs of the inward folding lines V100" may be formed at a distance Y300 larger than the specified width Y100 from the other pair of outward folding lines. In FIGS. 20A and 20B, since the inward and outward folding lines other than the inward folding line V100" and the outward folding line M700" are identical with those in FIGS. 11 to 15C, they are denoted by the same numeral with the description thereof being omitted.

Figure 22:
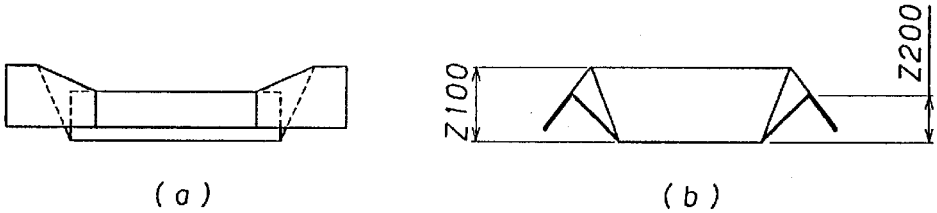
FIG. 22A is a front view showing the package carton shown in FIG. 21.
FIG. 22B is a side view showing the package carton shown in FIG. 21.
Figure 21:
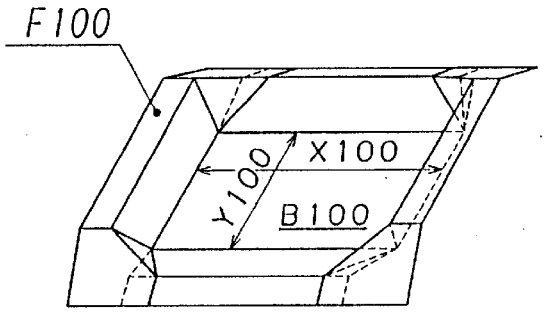
FIG. 21 is a perspective view showing the packaging carton completed by folding the quadrilateral sheet shown in FIGS. 20A and 20B.

The quadrilateral sheet SS100" is folded in the same way as explained above to be provided as a packaging carton as shown in FIG. 21 and FIG. 22. This provided packaging carton has a flange F100 as a plane formed in parallel with the bottom plane B100 with a length allowed to be longer than that of the carton made by folding the quadrilateral sheet SS100.

Fourth Embodiment

Figure 23:
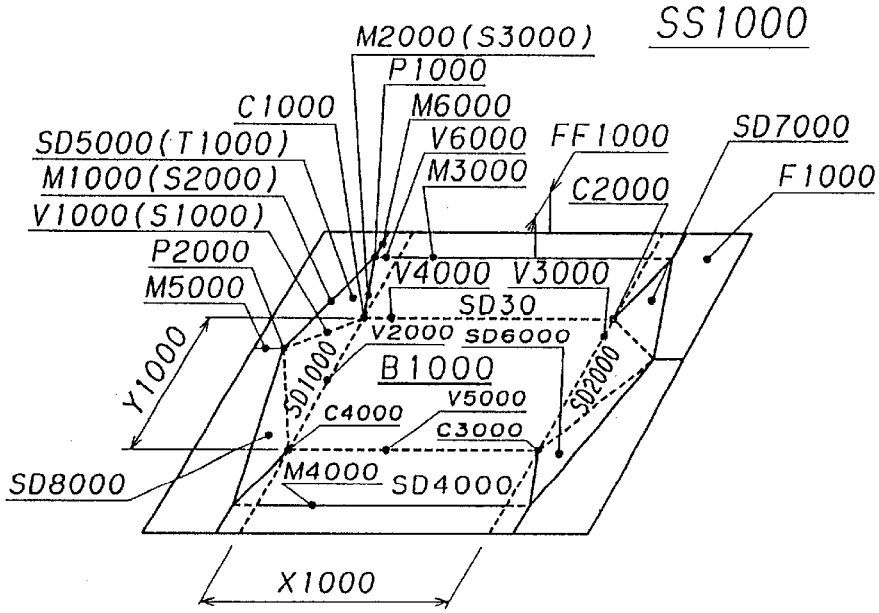
FIG. 23 is a perspective view showing a quadrilateral sheet provided with inward folding lines and outward folding lines for forming a packaging carton in a fourth embodiment according to the present invention.
Figure 25:
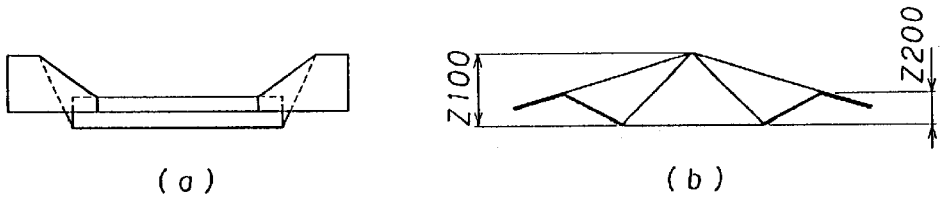
FIG. 25A is a front view showing the package carton in the fourth embodiment according to the present invention.
FIG. 25B is a side view showing the package carton in the fourth embodiment according to the present invention.
Figure 24:
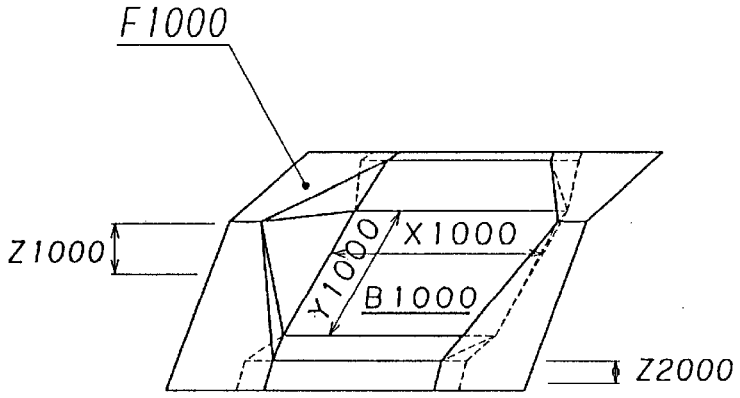
FIG. 24 is a perspective view showing the packaging carton in the fourth embodiment according to the present invention.

In the embodiment, a packaging carton according to the present invention is made in a polyhedron by folding a quadrilateral sheet SS1000 as shown in FIG. 23, FIG. 24 and FIG. 25. The package carton made in a polyhedron is formed to have a bottom plane B1000 with specified length X1000 and width Y1000, a pair of facing triangular long side planes SD1000 and SD2000 each with a specified long height Z1000, a pair of facing quadrilateral short side planes SD3000 and SD4000 each with a specified short height Z2000, and two pairs of facing inclined side planes SD5000 to SD8000 each being in a form of a triangle T1000 formed between the long side plane and the short side plane with one side S1000 connected to the long side plane, one side S3000 of the other two sides connected to the short side plane and one of vertices between the above sides being at one of four corner points C1000 to C4000 of the bottom plane, and a flange F1000 formed with a continuous face and provided around a periphery.

In order to make the package carton, the quadrilateral sheet SS1000 comprises: two first inward folding lines V2000 and V3000 each being formed to pass two of four corner points C1000 to C4000 of a bottom plane B1000 of the polyhedron having the specified length X1000 and width Y1000, and to have a length equal to a sum of the specified width Y1000, twice the specified short height Z2000, and twice a width of the flange FF1000; two second inward folding lines V4000 and V5000 each being formed to cross the two first inward folding lines V2000 and V3000 at right angles, and to have a length equal to the specified length X1000; two outward folding lines M3000 and M4000 each being formed to have a length equal to the length of the second inward folding line V4000 or V5000 and to be in parallel therewith with a distance therefrom equal to the specified short height Z2000; and two outward folding lines M5000 each formed to extend in parallel with the second inward folding line V4000 or V5000 from a vertex P2000 of each of the pair of the triangles of the long side planes SD1000 and SD2000.

Figure 26:
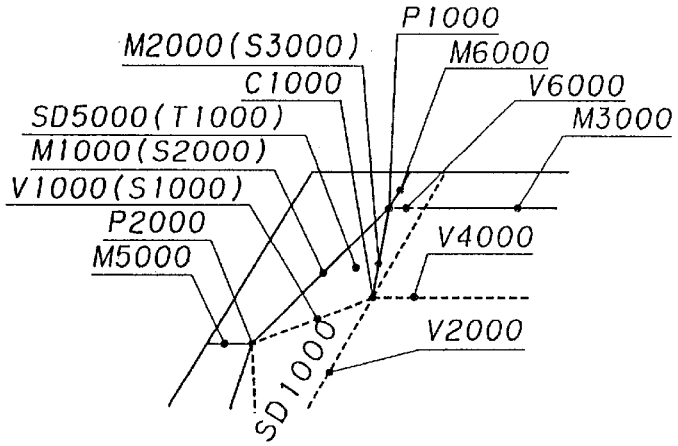
FIG. 26 is a partial perspective view showing a region at a corner of the quadrilateral sheet provided with inward folding lines and outward folding lines for forming the packaging carton in the fourth embodiment according to the present invention.

In a region formed at each of the four corners of the quadrilateral sheet SS1000 between the long side plane SD1000 or SD2000 and the short side plane SD3000 or SD4000, as shown in FIG. 26, the region including the inclined side plane SD 5000 as the triangle 1000 comprises: an inward folding line V1000 forming the one side S1000 of the triangle T1000 connected to the one of the long side planes SD1000 and SD2000; two outward folding lines M1000 and M2000, forming the other two sides S2000 and S3000 of the triangle T1000, drawn from a point P1000 as one of the other vertices at a distance from an imaginary extension of the second inward folding line being equal to the short height Z2000 of the short side plane; an inward folding line V6000 formed to extend in parallel with the second inward line V4000 or V5000 to the point P1000 as one of the other vertices from an end of one of the two outward folding lines M3000 and M4000; and an outward folding line M6000 formed to extend from the point P1000 as the one of the other vertices of the triangle T1000 in parallel with the first inward folding line V2000 or V3000. Therefore, such inward folding line V6000 and the outward folding lines M1000, M2000 and M5000 are also provided in other three regions at the respective three other corners of the quadrilateral sheet SS1000 including the inclined side planes SD6000 to SD8000 (FIG. 23).

In FIG. 23 and FIG. 26, the inward folding lines and the outward folding lines are represented by broken lines and solid lines, respectively.

The quadrilateral sheet SS1000 (FIG. 27A) comprising the above inward folding lines and outward folding lines shown in FIG. 23 and FIG. 26 is folded as described below.

Figure 27:
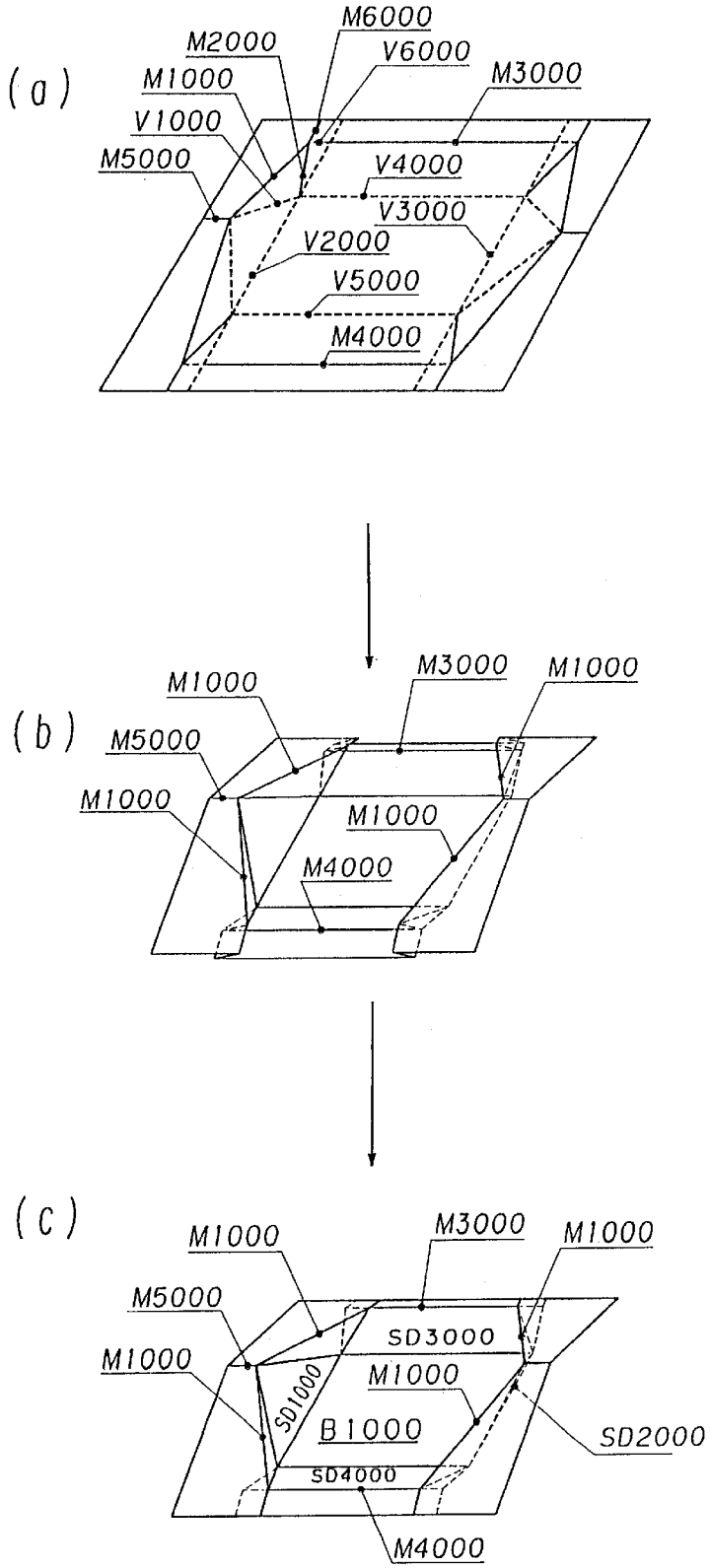
FIGS. 27A to 27C are perspective views showing the steps of forming the packaging carton in the fourth embodiment according to the present invention.

The two first inward folding lines V2000 and V3000, and the two second inward folding lines V4000 and V5000 are folded inward, and the two outward folding lines M3000 and M4000, and the two outward folding lines M5000 are folded outward. Further, in each of regions at the four corners of the quadrilateral sheet SS1000, the inward folding lines V1000 and V6000 are folded inward, and the two outward folding lines M1000 and M2000, and the outward folding line M6000 are folded outward, by which a package carton is obtained in a form before being completed (FIG. 27B). Following this, the above inward and outward folding is further carried out completely to completion of the package carton (FIG. 27C), which is formed with the four side planes SD1000 to SD4000 each connected by the triangle T1000 on the bottom plane B1000 of the polyhedron, two outward folding lines M3000 and M4000 each connected by the four outward folding line M1000, and a flat flange F1000 extending from the outward folding lines M3000, M4000, and M1000 in the horizontal direction on all sides of the periphery. The four side planes SD1000 to SD4000 are formed so that each of the long side planes SD1000 and SD2000 is in a triangle each with the specified long height Z1000 and each of the short side planes SD3000 and SD4000 is in a rectangle with the specified short height Z200. This allows the flange F1000 to have a form of being bent downward with each of the outward folding lines M5000 taken as the central lines, namely, to be inclined planes.

Figure 28:
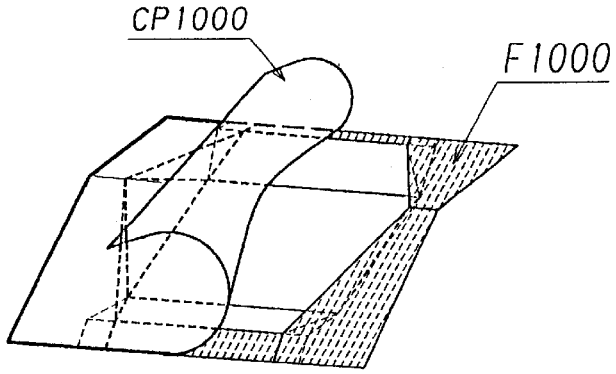
FIG. 28 is a perspective view showing the step of sealing the packaging carton in the fourth embodiment according to the present invention.

Into the packaging carton thus formed, contents (not shown in the drawings) are put to be held with a sealing cover CP 1000 (FIG. 28) is applied over the contents and mounted on the flange F100 to be bonded thereto by, for example, fusing to constitute a sealed packaging carton in which contents such as food or drink are held.

In the above embodiments, when folding the sheet or film to make the tray carton it is possible to bond simultaneously the portions folded each other by fusion or adhesion with adhesives contained in the sheet or film per se. The folded ribs in the four corner increase the mechanical strength of the tray carton. The tray carton does not cause the liquid leakage because it relies on the folding of the sheet or film if it is used as a packaging carton for packing foods. The sheet or film is not cut, resulting in the effect to produce no chips of the carton blank for the better environment.

As is apparent from the above embodiments, the package carton according to the present invention can be provided to have a flat flange, on the upper face of which a sealing cover such as a transparent film can be bonded by fusion or adhesion with adhesives, so that it can be manufactured inexpensively and efficiently.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A packaging carton made by folding a quadrilateral sheet (S1) in a polyhedron having specified length, width and height (X1, Y1, Z1) with a flat flange (F1) provided around a periphery thereof, the quadrilateral sheet comprising:

four inward folding lines (V1 to V4) each being formed to pass two of four corner points (C1 to C4) of a bottom plane (B1) of the polyhedron having the specified length and width; and four outward folding lines (M1 to M4) each being formed to be in parallel with each of the four inward folding lines with a distance therefrom equal to the specified height, and to have a length equal to a distance between the two of the four corner points (L1 or L2) on the inward folding line in parallel therewith, and in a region formed at each of four corners of the quadrilateral sheet between two of four side planes (SD1 to SD4) formed between the four inward folding lines and the four outward folding lines, respectively, the region comprising:

three outward folding lines (M5 to M7) forming a triangle (T1) extending from a vertex (P1) at one of the corner points;

two outward folding lines (M8 and M9) each being formed to extend from each of the other two vertices (P2 and P3) of the triangle in parallel with one of the four outward folding lines forming the side plane beyond the rest of the other two vertices; and two inward folding lines (V5 and V6) each being formed to extend from an end (G1 to G8) of one of the four outward folding lines forming one of the side planes to one of the other two vertices near the end.

2. A packaging carton made by folding a quadrilateral sheet (S10) in a polyhedron having specified length, width and height (X10, Y10, Z10) with a flat flange (F10) provided around a periphery thereof, the quadrilateral sheet comprising:

four inward folding lines (V10 to V40) each being formed to connect two of four corner points (C10 to C40) of a bottom plane (B10) of the polyhedron having the specified length and width; and four outward folding lines (M10 to M40) each being formed to be in parallel with each of the four inward folding lines with a distance therefrom equal to the specified height, and in a region formed at each of four corners of the quadrilateral sheet including each of the four corner points, the region comprising:

two inward folding lines (V50 and V60) being formed to extend from one of the corner points to ends (two of G10 to G80) of the two of the four outward folding lines near the corner point, respectively;

one inward folding line (V70) being formed to connect the ends of the two of the four outward folding lines near the corner point;

one outward folding line (M50) dropped from the corner point (C10) as a vertex (P10) of a triangle (T10), formed with the two inward folding lines and the one inward folding line, to the one inward folding line as a base so as to divide the triangle into two;

two inward folding lines (V80 and V90) each being formed to extend from each of the other two vertices (P20 and P30) of the triangle in parallel with one of the four outward folding lines extended to the end as the rest of the other two vertices; and two outward folding lines (M60 and M70) each being formed to extend from an end (G90) of the one outward folding line on the one inward folding line as the base so as to be in parallel with one of the four outward folding lines extended to the one of the other two vertices beyond the other of the two outward folding lines.

3. A packaging carton made by folding a quadrilateral sheet (SS100) in a polyhedron formed to have a bottom plane (B100) with specified length and width (X100 and Y100), a pair of facing long side planes (SD100 and SD200) each with a specified long height (Z100), a pair of facing short side planes (SD300 and SD400) each with a specified short height (Z200), two pairs of facing inclined side planes (SD500 to SD800) each being in a form of a triangle (T100) formed between the long side plane and the short side plane with one side (S100) connected to the long side plane, one (S300) of the other two sides connected to the short side plane and one vertex between the above sides being at each of four corner points (C100 to C400)of the bottom plane, and a flange (F100) formed with a continuous face and provided around a periphery, the quadrilateral sheet comprising:

two first inward folding lines (V200 and V300) each being formed to pass two of four corner points (C100 to C400) of a bottom plane of the polyhedron having the specified length and width, and to have a length equal to a sum of the specified width, twice the specified short height, and twice a width of the flange (FF100);

two second inward folding lines (V400 and V500) each being formed to cross the two first inward folding lines at right angles to connect two of the four corner points, and to have a length equal to the specified length;

two outward folding lines (M500 and M600) each being formed to have a length equal to the specified length between two of the four corner points and to be in parallel with one of the second inward folding lines with a distance therefrom equal to the specified short height;

two pairs of inward folding lines (V100) each line extending from each end of the second inward folding line at one of the four corner points, and forming the one side (S100) of the triangle (T100) connected to the one of the long side planes;

two pairs of outward folding lines (M700) each pair being formed to extend from both ends of each pair of the inward folding lines (V100) in parallel with the second inward line; and two outward folding lines (M300 and M400) each being formed to have a length equal to a distance between the two pairs of the outward folding lines and to be in parallel with one of the first inward folding lines with a distance therefrom equal to the specified long height, and in a region formed at each of four corners of the quadrilateral sheet between the long side plane and short side plane, the region comprising:

an inward folding line (V600) being formed to extend from one of the two outward folding lines having the length equal to the specified length, and being in parallel with the second inward folding line;

two outward folding lines (M100 and M200), forming the other two sides (S200 and S300) of the triangle (T100), drawn from a point (P100) as one of the other vertices at an end of the inward folding line (V600); and an outward folding line (M800) formed to extend from the point as the one of the other vertices of the triangle in parallel with the first inward folding line.

4. A packaging carton as claimed in claim 3 wherein each pair of the two pairs of outward folding lines being formed to extend from both ends of each pair of the two pairs of the inward folding lines (V100) are formed at a distance equal to the specified width (Y100) from the other pair of outward folding lines.

5. A packaging carton as claimed in claim 3 wherein each pair of the two pairs of outward folding lines being formed to extend from both ends (G100 and G200, or G300 or G400) of each pair of the two pairs of the inward folding lines (V100') are formed at a distance (Y200) smaller than the specified width (Y100) from the other pair of outward folding lines.

6. A packaging carton as claimed in claim 3 wherein each pair of the two pairs of outward folding lines being formed to extend from both ends (G1100 and G1200, or G1300 or G1400) of each pair of the two pairs of the inward folding lines (V100") are formed at a distance (Y300) larger than the specified width (Y100).

7. A packaging carton made by folding a quadrilateral sheet (SS1000) in a polyhedron having a bottom plane (B1000) with specified length and width (X1000 and Y1000), a pair of facing triangular long side planes (SD1000 and SD2000) each with a specified long height (Z1000), a pair of facing quadrilateral short side planes (SD3000 and SD4000) each with a specified short height (Z2000), two pairs of facing inclined side planes (SD5000 to SD8000) each being in a form of a triangle (T1000) formed between the long side plane and the short side plane with one side (S1000) connected to the long side plane, one (S3000) of the other two sides connected to the short side plane and one of vertices between the above sides being at one of four corner points (C1000 to C4000)of the bottom plane, and a flange (F1000) formed with a continuous face and provided around a periphery, the quadrilateral sheet comprising:

two first inward folding lines (V2000 and V3000) each being formed to pass two of four corner points (C1000 to C4000) of a bottom plane of the polyhedron having the specified length and width, and to have a length equal to a sum of the specified width, twice the specified short height, and twice a width of the flange (FF1000);

two second inward folding lines (V4000 and V5000) each being formed to cross the two first inward folding lines at right angles, and to have a length equal to the specified length;

two outward folding lines (M3000 and M4000) each being formed to have a length equal to the length of the second inward folding line and to be in parallel therewith with a distance therefrom equal to the specified short height; and two outward folding lines (M5000) each formed to extend in parallel with the second inward folding line from a vertex (P2000) of each of the pair of the triangles of the long side planes, and in a region formed at each of four corners of the quadrilateral sheet between the long side plane and short side plane, the region comprising:

an inward folding line (V1000) forming the one side (S1000) of the triangle (T1000) connected to the one of the long side planes;

two outward folding lines (M1000 and M2000), forming the other two sides (S2000 and S3000) of the triangle, drawn from a point (P1000) as one of the other vertices at a distance from an imaginary extension of the second inward folding line being equal to the short height of the short side plane;

an inward folding line (V6000) formed to extend in parallel with the second inward line to the point (P1000) as one of the other vertices from an end of one of the two outward folding lines (M3000 and M4000); and an outward folding line (M6000) formed to extend from the point as the one of the other vertices of the triangle in parallel with the first inward folding line.

* * * * *